US005382377A

United States Patent [19]

Raehse et al.

[11] Patent Number: 5,382,377

[45] Date of Patent: * Jan. 17, 1995

[54] PROCESS FOR THE PRODUCTION OF DETERGENTS

[75] Inventors: Wilfried Raehse, Duesseldorf; Jochen Jacobs, Wuppertal; Hans Kruse, Korschenbroich; Guenther Vogt, Toenisvorst; Eduard Smulders, Hilden; Monika Boecker, Duesseldorf, all of Germany

[73] Assignee: Henkel Kommanditgesellschaft auf Aktien, Duesseldorf, Germany

[ * ] Notice: The portion of the term of this patent subsequent to Jun. 7, 2011 has been disclaimed.

[21] Appl. No.: 930,672

[22] PCT Filed: Mar. 25, 1991

[86] PCT No.: PCT/EP91/00567

§ 371 Date: Dec. 2, 1992

§ 102(e) Date: Dec. 2, 1992

[87] PCT Pub. No.: WO91/15567

PCT Pub. Date: Oct. 17, 1991

[30] Foreign Application Priority Data

Apr. 2, 1990 [DE] Germany ..... 4010533

[51] Int. Cl.[6] ..... C11D 17/00

[52] U.S. Cl. ..... 252/174; 252/89.1; 264/118; 264/123; 264/141; 264/142; 264/143

[58] Field of Search ..... 264/118, 123, 141, 142, 264/143; 252/174, 89.1

[56] References Cited

U.S. PATENT DOCUMENTS

| | | | |
|---|---|---|---|
| 3,118,183 | 1/1964 | Gex et al. | 18/20 |
| 3,337,915 | 8/1967 | Alexander | 18/16 |
| 3,371,136 | 2/1968 | Johannsen | 264/109 |
| 3,627,865 | 3/1969 | Wittmer | 264/118 |
| 4,587,031 | 5/1986 | Kruse et al. | 252/135 |
| 4,642,197 | 2/1987 | Kruse et al. | 252/98 |
| 4,675,124 | 7/1987 | Seiter et al. | 252/91 |
| 4,722,802 | 2/1988 | Hutchings et al. | 252/174 |
| 4,828,749 | 5/1989 | Kruse et al. | 252/135 |
| 4,839,078 | 6/1989 | Kruse et al. | 252/99 |
| 4,897,212 | 1/1990 | Kruse et al. | 252/99 |
| 4,933,100 | 6/1990 | Ramachandran | 252/95 |
| 5,002,691 | 3/1991 | Bolkan et al. | 252/186.25 |
| 5,034,147 | 7/1991 | Ramachandran | 252/95 |
| 5,075,058 | 12/1991 | Chan et al. | 264/118 |

FOREIGN PATENT DOCUMENTS

| | | |
|---|---|---|
| 0224128 | 6/1987 | European Pat. Off. . |
| 0224129 | 3/1988 | European Pat. Off. . |
| 0291097 | 11/1988 | European Pat. Off. . |
| 0832880 | 8/1989 | European Pat. Off. . |
| 0355626 | 2/1990 | European Pat. Off. . |
| 1467564 | 10/1969 | Germany . |
| 1502303 | 10/1969 | Germany . |
| 3315950 | 11/1984 | Germany . |
| 8816064 | 4/1989 | Germany . |
| 3926253 | 2/1991 | Germany . |
| 120412 | 9/1970 | United Kingdom . |

*Primary Examiner*—Linda Skaling
*Assistant Examiner*—Michael P. Tierney
*Attorney, Agent, or Firm*—Ernest G. Szoke; Wayne C. Jaeschke; Real J. Grandmaison

[57] ABSTRACT

The process of producing a detergent in the form of portioned pressings by extrusion of a homogeneous premix containing a plasticizer or lubricant into strands through a perforated die under a pressure of from about 25 to about 200 bar and forming compacted granules thereof, and then pressing the compacted granules into portioned pressings such as tablets.

7 Claims, No Drawings

PROCESS FOR THE PRODUCTION OF DETERGENTS

This invention relates to a process for the production of domestic and institutional detergents in the form of portioned pressings. The present invention also relates to these detergents in the form of portioned pressings. The elements crucial to the invention are described in the following with reference by way of example to laundry detergents. However, the teaching according to the invention is by no means confined to this particular application.

Laundry detergents based on surfactant-containing mixtures not only in the form of powders or fine-particle agglomerates, but also in the form of relatively large, portioned pressings have long been the subject of wishful thinking which has often been recorded in the literature on domestic detergents. In practice, laundry detergents in portioned form, for example in the form of tablets, cubes and the like, particularly for domestic washing machines, have never been successful because the requirements which portioned forms such as these are expected to satisfy are both complex and contradictory. Thus, portioned pressings not only have to show stability in storage over considerable periods, they also have to be capable of withstanding impact stressing over the same period so that they do not disintegrate, for example during transport or if accidentally dropped during handling. In practical application, however, pressings have to dissolve quickly and reliably under the effect of the washing water in the same way as the user has come to expect of commercially available washing powders. Portioned pressings, which are large by comparison with powder particles, actually have to dissolve completely in the times predetermined by the machine wash cycle.

DISCUSSION OF RELATED ART

German patent application 14 67 564 (Colgate) describes a process for the production of detergent tablets in which a fine-particle detergent of high silicate content is produced, water is added and the mixture is compacted under a light pressure of about 0.2 bar to about 1.8 bar to form a tablet.

According to German patent application 33 15 950, detergent tablets combining high mechanical strength with a high dissolving rate are obtained if, in their production, the highly alkaline constituents are first granulated and subsequently tabletted, optionally with addition of tabletting aids, for example sodium acetate, citrate or tartrate. Standard eccentric and rotary-table presses are suitable for this purpose.

According to the teaching of European patent application 291 097, bleaches containing active chlorine can be produced by first extruding a moist paste and then granulating the extrudate in a granulating machine or rounding it in a Marumerizer. After drying, the granules obtained in this way are converted into the portioned form in conventional tabletting machines.

Typical tabletting machines include those which are described, for example, in German patent application 15 02 303, in German utility model 88 16 064.5 and in U.S. Pat. Nos. 3,371,136, 3,337,915 and 3,118,183.

European patent application 328 880 (Colgate) describes the production of detergents based on surfactants and associated hydratable builders in extruded strand or rodlet form and, in addition, states that portioned products in "patty" form are produced from the extruded strands by light pressing. The dimensions of the portioned pressing are such that one tablet and, in some cases, even half a tablet covers the detergent demand of a machine washing cycle. The teaching of this document discusses the various difficulties—merely touched upon in the foregoing—involved in the marketing of portioned laundry detergents such as these. The technical solution described in European patent application 328 880 essentially comprises the following elements: both the first stage of the process, in which the mixture is extruded in strand form, and the second stage, in which the extrudates are converted into patty form, use mixtures which have a comparatively high water content which enables extremely low pressures to be applied in both stages. A pressure range of from about 0.1 to 0.5 bar is mentioned for the extrusion stage and the same pressure range is said to be used for combining the strand-like extrudate obtained into the patty-like form. By virtue of the relatively high water content of 20 to 35% by weight, the solid mixture of the detergent ingredients is virtually plasticized under normal conditions and shows coherent and even flexible properties in this form. The mixtures are said to have a density of about 700 to 800 g/l. The individual portions are then said to be individually wrapped in tear-open polymer films, particularly PVC films.

The problem addressed by the present invention was to provide a detergent in the form of a portioned pressing which would combine high stability in storage with high impact resistance without having to be wrapped in a film impermeable to water vapor. The pressing would disintegrate rapidly on contact with an aqueous phase, for example in the form of a wash liquor.

DESCRIPTION OF THE INVENTION

Other than in the operating examples, or where otherwise indicated, all numbers expressing quantities of ingredients or reaction conditions used herein are to be understood as modified in all instances by the term "about".

In a first embodiment, therefore, the present invention relates to a process for the production of detergents in the form of portioned pressings, compacted granules being converted into these portioned pressings. The production of the "compacted granules" used in accordance with the invention is the subject of earlier patent application DE 39 26 253. In the corresponding process, a homogeneous premix is extruded in strand form through perforated dies having predetermined bore diameters under pressures of 25 to 200 bar and with addition of a plasticizing agent and/or lubricant. Immediately after leaving the perforated die, the strand is cut into granules of predetermined size by means of a cutting unit. Application of the high working pressure plasticizes the premix during formation of the granules and ensures that the freshly extruded strands can be cut.

The premix consists at least partly of typical solid, preferably fine-particle, ingredients of detergents to which liquid constituents may optionally be added. The solid ingredients may be spray-dried tower powders and also agglomerates, which contain the particular constituents selected for the mixture in the form of pure substances which are mixed together in fine-particle form, and also mixtures of agglomerates and tower powders. The liquid ingredients, if any, are then added and the plasticizer and/or lubricant selected in accordance with the invention is subsequently introduced.

The plasticizers and/or lubricants used as auxiliaries may be fluid, gel-like or paste-like at room temperature without an additional liquid phase having to be used. Preferred plasticizers and/or lubricants are preparations based on surface-active components and/or on polymer compounds soluble or emulsifiable or dispersible in water. Examples of a plasticizer and/or lubricant which may be used without an additional liquid phase are many types of the nonionic surfactants typically used in detergents.

However, one preferred embodiment is characterized by the use of plasticizers and/or lubricants which have been produced using limited quantities of auxiliary liquids, preferably in the form of water-soluble of water-miscible organic liquid phases. In the interests of process safety, it may be advisable to use comparatively high-boiling organic liquids, optionally in admixture with water. Examples of such liquids are relatively high-boiling, optionally polyhydric alcohols, polyalkoxylates which flow at room temperature or moderately elevated temperatures and the like. However, water-based preparations of the plasticizers and/or lubricants are particularly preferred.

The surfactants and/or polymer compounds used as plasticizers and/or lubricants are advantageously introduced into the process in such concentrated form that the consistency of the plastic, smoothly pressable paste can be established with only small quantities of these auxiliaries. They are preferably used in paste-like form and in quantities of not more than 12% by weight, more particularly in quantities of 0.5 to 10% by weight and, with particular advantage, in quantities of 3 to 8% by weight, based on the mixture as a whole. At least 30% by weight and, preferably, at least 40% by weight pastes and gels are particularly suitable.

One particularly preferred embodiment is characterized by the use of surfactant preparations having a surfactant content of at least 50% by weight and, more particularly, 50 to 70% by weight. These highly concentrated aqueous surfactant mixtures may be described as paste-like or gel-like preparations of lubricant character. In addition, in another embodiment in which the granules initially formed are dried, the surfactant components form binder-like surface layers and interlayers which are jointly responsible for the cohesion of the granules. Particular significance is attributed in this regard to anionic surfactant salts, more particularly sulfates and sulfonates, from the broad range of compounds proposed herein for detergents which may optionally be used together with typical nonionic compounds. A mixture of at least two powder components (tower powder/carrier bead), with or without added sodium perborate (monohydrate and/or tetrahydrate), containing 2 to 5% by weight water and 4 to 8% by weight of a 55 to 65% by weight $C_{9-13}$ alkylbenzenesulfonate paste (ABS paste) is mentioned as an example for the production of laundry detergents. It is equally preferred to use 3 to 8% by weight of a 50 to 60% by weight aqueous paste of an alkyl polyglycoside (APG) corresponding to the general formula $RO(G)_x$, in which R is a primary, saturated or 2-methyl-branched aliphatic radical containing 8 to 22 and preferably 8 to 18 carbon atoms, G is a symbol which stands for a glycose unit containing 5 or 6 carbon atoms and the degree of oligomerization x is between 1 and 10. Other preferred surfactant-based plasticizers and/or lubricants are mixtures of ABS and APG pastes and also mixtures of APG:ethoxylated fatty alcohol:water in a ratio of 0.5–1:1–1.5:1, the APG content in this case being counted as active substance and not as paste.

In the same way as surfactants, polymer compounds are now commonly used in numerous detergents, for example because they can act as builders with the ability to bind water hardness. Examples of such polymer compounds are carboxyfunctional polymers which may also be present in salt form, for example as alkali metal salts, such as the sodium or potassium salts of homopolymeric or copolymeric polycarboxylates, for example polyacrylates, polymethacrylate and, in particular, copolymers of acrylic acid with maleic acid, preferably those of 50% to 10% maleic acid. The relative molecular weight of the homopolymers is generally in the range from 1,000 to 100,000 while the relative molecular weight of the copolymers is generally in the range from 2,000 to 200,000 and preferably in the range from 50,000 to 120,000, based on the free acid. Suitable, but less preferred compounds of this class are copolymers of acrylic acid or methacrylic acid with vinyl ethers, such as vinyl methyl ethers, vinyl esters, acrylamide or methacrylamide, ethylene, propylene and styrene, in which the acid makes up at least 50%. However, polymer compounds are also used to improve the soil suspending power of an aqueous wash liquor. Examples of such polymer compounds are carboxymethyl cellulose (CMC) and/or methyl cellulose (MC).

In the same way as the surfactant-containing preparations, highly concentrated aqueous preparations of these polymer compounds are distinguished in particular by a pronounced lubricant character. At the same time, these polymer components dry during formation of the granules to form polymer films which, on the one hand, promote the cohesion of the granules and, on the other hand, readily revert to the state of a solution, emulsion or dispersion when introduced in particular into aqueous media. It is particularly preferred to use 3 to 8% by weight of a 30 to 50% by weight solution of a polymeric salt, more particularly a copolymeric salt of acrylic acid and maleic acid, in water as plasticizer and/or lubricant. Mixtures of these polymer solutions and the plasticizers and/or lubricants based on surfactants, particularly anionic surfactants, are also advantageous.

Many other natural or synthetic polymers which may also be used as plasticizers and/or lubricants in accordance with the invention are known in practice. Gelatine, starch and starch derivatives and also polyvinyl alcohol are mentioned purely by way of example.

Slightly larger quantities of liquid may be necessary to achieve sufficient moistening in order to prevent the emission of dust from the premix. In general, it is best to add the additional liquid as such to the premix rather than, for example, diluting the surfactant pastes and/or polymer solutions used as lubricant to a greater extent. The quantities of liquid involved may be introduced before, during or after incorporation of the plasticizer and/or lubricant and are preferably introduced before incorporation of the plasticizer and/or lubricant. However, the quantities of liquid phase(s) used are so limited that the premix initially retains its free-flowing, powder-form structure during simple mixing, even after addition of the plasticizer and/or lubricant. In this stage, the content of free water which is not bound as water of crystallization or in comparable form in the particular mixture is preferably up to 12% by weight, more preferably up to 10% by weight and, most preferably, in the range from about 4 to 8% by weight. The water introduced via the lubricant-like plasticizing aid is included in these figures.

If desired, other solids may be added to the premix after the plasticizer and/or lubricant. The paste as a whole is then briefly mixed to form a solid and preferably free-flowing premix which is suitable for charging a homogenizing machine.

Kneaders of any type, for example twin-screw kneaders, may be used with advantage as the homogenizing unit. In general, it may be advisable to guarantee safe temperature control of the mixture to be processed in this homogenizing step, the particular composition of the mixture being a determining factor with regard to the optimal temperature range. The intensive mixing operation itself can provide the desired increase in temperature. Moderately elevated temperatures, for example of at most 60° to 70° C., are generally not exceeded. Where temperature-sensitive substances, for example perborate compounds, are used, it may be of advantage to apply low temperatures (for example from about 40° to 45° C.).

Under the shearing effect of the kneading machine and the high pressure of 25 to 200 bar and preferably 30 to 200 bar building up therein, the premix is so intensively compounded and kneaded that the previously solid and dry-looking mixture is converted into the compacted, plasticized and extrudable paste. At the same time, the cuttability of the homogenized mixture is guaranteed in this way.

In one preferred embodiment, the free-flowing premix is preferably delivered continuously to a twin-screw kneader (extruder) of which the housing and the extruder/granulation head are heated to the predetermined extrusion temperature, for example in the range from 40° to 60° C. Under the shearing effect of the extruder screws, the premix is compacted under pressures of 50 to 200 bar and, more particularly, under pressures of 80 to 180 bar, plasticized, extruded in the form of thin strands through the perforated die in the extruder head and, finally, the extrudate is size-reduced by means of a rotating blade, preferably to spherical or cylindrical granules. The bore diameter in the perforated die and the length to which the strands are cut are adapted to the particular size selected for the granules. In this embodiment, it is possible to produce granules having a substantially uniformly predeterminable particle size. Absolute particle sizes may lie, for example, in the range from a few tenths of a millimeter to a few centimeters, i.e. for example in the range from about 0.3 mm to 1–2 cm. However, particle diameters of up to at most 0.8 cm, for example in the range from 0.5 to 5 mm and, more particularly, in the range from about 0.8 to 3 mm, are preferred. The length-to-diameter ratio of the primary granules is preferably in the range from about 1:1 to about 3:1.

The steps of homogenization, compaction and extrusion of the particular premix used require only very short times. Normally, times of only a few minutes, preferably less than 5 minutes and, in particular, no more than 3 minutes, are required to convert the premix into compacted, plasticized primary granules.

In general, it is not necessary, but may be of advantage depending on the formulation, to cool at least the surface of the strands issuing from the perforated die by shock cooling, more particularly by blowing cold air into the vicinity of the granulating blade. At the same time, surface water is thus partly removed from the primary granules formed. If necessary, the still plasticized granules can be safely prevented from adhering to one another in this way.

However, granulation in this first step of the process is not confined to processing of the plasticized premix using screw extruders and perforated dies of the described type arranged in the extruder head. Mixtures plasticized, compacted and homogenized in accordance with the invention can also be granulated to compacted primary granules in standard pellet presses and similar granulating machines.

There is normally no need to incorporate small quantities of dry powder in the still plasticized primary granules. However, it is possible in this way safely to prevent the individual granules from undesirably adhering to one another before they are finally dried. Suitable powders may be typical ingredients of detergents. One suitable ingredient is, for example, zeolite powder of detergent quality, for example corresponding zeolite NaA powder. However, further significance may be attributed to important auxiliaries, which may be used in this stage of the process, for the subsequent redissolution of the portioned pressings. Of particular significance in this regard are, above all, finely powdered, inorganic or organic additives, for example with the ability to swell and/or release gas in aqueous phase, which act as disintegrators, and/or cold-soluble components which promote rapid penetration of the aqueous phase into the portioned pressings. Microcrystalline cellulose has proved to be particularly effective in this regard. However, further particulars will be provided hereinafter.

These powders may be incorporated using standard mixing machines or commercially available rounding machines in which the granules are given a spherical or at least substantially spherical shape by rounding of the edges present. Preferred rounding machines have a rotating bottom disk and the desired degree of rounding can be adjusted by varying the residence time of the granules in the rounding machine and/or the rotational speed of the disk.

The primary granules are then preferably subjected to a drying step, for example in a fluidized-bed dryer, in which—for moderately elevated inflowing air temperatures, more particularly up to at most 80° C.—correspondingly moderate end product temperatures of, for example, 55° to 60° C. are established and, having been established, are not exceeded. After adequate drying, the product is cooled, for example with cold air. The free water content of the granules can be reduced in this way. Preferred residual contents of unbound water are up to about 1% by weight and are preferably in the range from about 0.1 to 0.5% by weight. The very low-dust product accumulating can be graded, for example by sieving, to remove the few coarse particles formed. In general, more than 90% and preferably more than 95% of the granulated material has the particle size to be established in accordance with the invention.

However, "internal drying" of the granules is also possible, at least in part. By using moisture-binding constituents in the premix, the plasticizing effect of the liquid components initially introduced can be utilized in the short processing time. Through the at least partial binding of these liquid components by the constituents incorporated, the granules dry "from inside" so that external drying can be shortened or omitted altogether. Constituents which are capable of binding water in the form of water of crystallization are, for example, sodium sulfate and/or sodium carbonate in anhydrous or substantially anhydrous form or even a zeolite partly freed from water of crystallization.

In another preferred embodiment, the still plastic primary granules can be treated with other active substances before, during and/or after the optional rounding step. In one preferred embodiment, for example, sensitive, particularly temperature-sensitive, constituents of the formulation can be added to the dried granules, for example by spraying and/or in the form of separately produced granules, to form a multiple-grain mixture. In the same way as in the conventional production of detergents, sensitive constituents, such as bleaches, bleach activators, enzymes, foam inhibitors, more particularly silicone foam inhibitors, fragrances and the like, may be added to the compacted granules before they are subjected to the final portioning step. In general, the constituents in question are temperature-sensitive materials which are used in quantities of less than 20% by weight, preferably in quantities of less than 10% by weight and, more preferably, in quantities of less than 5% by weight, based on the mixture as a whole. According to the teaching of German patent application 39 26 253, bleaches, such as perborate, can also be introduced into the compacted granules. In one advantageous embodiment, more than 60% by weight and, in particular, more than 70% by weight of the entire mixture is made up of compacted granules obtained in this way.

One particularly important embodiment of the invention is characterized by the use of granule systems which represent a combination of compacted granules differing in their composition. It is possible in this way to combine potentially reactive or at least only low-compatibility components in storable form. Selected and, in particular, compatible components are converted into the compacted granules and are then combined with other compacted granules before formation of the portioned pressings without any danger of unwanted reactions occurring during the storage and marketing of the pressings. One example of this are typical laundry detergents which, in the new form, use at least two types of granules in admixture with one another. In the first, for example spherical, type of granules, the bleach component, more particularly perborate containing water of crystallization and sodium carbonate, are pelleted using a proportion of the plasticizer and/or lubricant, while the zeolite used as builder, more particularly zeolite NaA of detergent quality, is pressed with the rest of the detergent constituents in the separate second type of granules. In this way, interactions between perborate and zeolite, which have to be taken into consideration in powder-form preparations because they significantly affect the stability of the mixed product in storage, are safely precluded.

The density and, hence, the apparent density of the granules is crucially determined by the working pressures applied during extrusion of the homogenized material through the perforated dies. For typical laundry detergent formulations, for example, apparent densities well above 700 g/l, preferably above 750 g/l and, more particularly, in the range from about 800 to approximately 1,000 g/l can be established by the buildup of a sufficiently compacted basic structure in the paste to be extruded and by the application of correspondingly high pressures. Thus, apparent densities of 850 to 980 g/l coupled with good flow properties and a preferably homogeneous, uniform spherical grain structure can be established in commercial laundry detergent formulations. Free-flowing granules having a uniform apparent density in the dry state of 950 to 980 g/l for an average particle size of the spherical granules of around 1 mm have been produced from similar mixtures.

It has been found that the compacted granules or mixtures of which at least 60% by weight consist of the compacted granules can be exposed to considerable pressures in the final portioning step without destruction of the structure of the compacted granules which would undesirably reduce the impact strength and breaking strength of the portioned pressings. The pressure applied in the portioning step is preferably in the range from 1 to 300 bar (10 to 3000N/cm$^2$), advantageously in the range from 5 to 200 bar (50 to 2000N/cm$^2$) and, more particularly, in the range from 10 to 150 bar (100 to 1500N/cm$^2$). Normally, the pressing conditions have to be optimized in each individual case for adjustment of the desired solubility of the portioned pressing coupled with sufficient strength or hardness thereof. It is well known in this connection that relatively high pressures reduce the rate at which the pressing dissolves in water. Preferred pressings have a breaking strength of at least 55N and, more particularly, in the range from 60 to 120N.

One important embodiment uses primary granules of which the composition is distinguished in particular by different surfactant contents. Thus, it can be advisable to use mixture which contain on the one hand granules containing nonionic surfactants and, on the other hand, granules which are at least substantially free from nonionic surfactants and, for example, essentially contain anionic surfactants as plasticizers. Pressings of this type frequently disintegrate more quickly on contact with water than comparison products of which the nonionic surfactant content is distributed throughout the granules.

The granules or granule mixtures are normally pressed at room temperature or, at best, moderately elevated temperatures, for example at temperatures of up to about 50° C. Pressing is preferably carried out at room temperature, i.e. at around 18° to 30° C. The duration of the pressing step is determined by the particular type of machine used and is generally less than 1 minute and normally of the order of a few seconds or even less.

The density established in the paste during the portioning step is determined by the predetermined densities of the starting material, the choice of any non-granulated mixtures components used and the conditions under which the portioning step is carried out. Portioned pressings according to the invention have densities which correspond at least to the density of the granules from the first step of the process, but are generally well above that density. Thus, density values (in g/cm$^3$) above 1 and, more particularly, above 1.1 to substantially the theoretical density of the multicomponent mixture are characteristic values. In the field of high-performance universal laundry detergents, portioned pressings having densities of from about 1.2 to 1.5 can be produced without having to make significant deviations in the formulation from typical commercial products.

The portioned pressings can be produced in predetermined shapes and sizes.

Thus, they may be made in virtually any easy-to-handle shapes, for example in the form of slabs, rods or bars, cubes, squares and corresponding shapes with flat side surfaces and, in particular, cylindrical shapes of circular or oval cross-section. This last shape covers the form of presentation from the tablet to compact cylindrical granules with a length-to-diameter ratio above 1.

The portioned pressings may be in the form of separate individual elements corresponding to a predetermined dose of the detergent. However, it is also possible to produce pressings which combine several such dose units in a single pressing, each individual portioned unit being made easy to break off, more particularly by predetermined weakened points. For the use of laundry detergents in machines of the type typically used in Europe with a horizontally mounted drum, the portioned pressings are best made in the form of cylindrical or square tablets, preferably with a length-to-diameter ratio of from about 0.5:2 to 2:0.5. Commercially available hydraulic presses, eccentric presses or rotary-table presses are suitable machines, more particularly for the production of pressings such as these.

Other important ingredients of the portioned pressings are tabletting aids with no effect of their own in the washing process and also additives which serve as dissolving or disintegrating aids for the portioned pressings on contact with an aqueous phase and which are preferably added to the primary granules after the first stage of the process and before the portioning step in quantities of no more than 15% by weight and, more particularly, in quantities of no more than 10% by weight, based on the pressing as a whole. Two classes which will be referred to as disintegrating agents and/or as cold-soluble mixture components are described purely by way of example in the following.

Disintegrating agents which promote the disintegration of the portioned pressings may be swellable inorganic and/or organic components. Typical inorganic disintegrating agents are, for example, fine-particle swellable layer silicates of the bentonite type. Organic disintegrating agents are natural substances or derivatives thereof based on starch and/or cellulose, alginates and the like. Typical examples which may be used in limited quantities are sodium alginate, crosslinked potato starch, methyl cellulose and/or hydroxypropyl cellulose and, above all, microcrystalline cellulose powder. Disintegrating agents of the type mentioned may be used in quantities of 5 to 10% by weight. Purely synthetic disintegrating agents, for example alkali metal salts of polyacrylates or polymethacrylates having comparatively low relative molecular weight, can also be of particular importance. Polymers of this type having average relative molecular weights in the range from about 1000 to 5000 and, more particularly, in the range from about 1000 to 3000 are distinguished by a strong dispersing effect even when used in small quantities, so that additions of less than 1% by weight can lead to substantial acceleration of the primary disintegration of the portioned pressings.

Typical examples of cold-soluble mixture components are readily soluble inorganic and/or organic salts. Alkali metal percarbonates and alkali metal acetates and also readily water-soluble compounds of the urea type are mentioned as examples. Sodium acetate is a tabletting aid known per se which is also useful for the purposes of the invention both in the production of the solid pressing and in its intended dissolution on contact with water. In the same way as a number of the swellable, fine-particle additives mentioned above among the disintegrating agents, percarbonates show both a desirable intrinsic effect in the detergent formulation and an additional effect as a tabletting aid.

In cases where typical detergents containing nonionic surfactants are used in accordance with the invention, it may be of advantage—depending on the quantity of nonionic surfactants present—to add desensitizing agents to the mixture containing the nonionic surfactants before the portioning step to prevent unwanted swelling of the nonionic surfactants and, hence, the formation of an aqueous nonionic surfactant gel in the outer shell of the pressing on contact with water. A gel skin would prevent the further penetration of water and hence the rapid disintegration of the pressing. An effective remedy against this premature swelling of the nonionic surfactants is provided in particular by desensitizing agents which are fluid at room temperature or at least mildly elevated temperatures. Examples of such desensitizing agents are paraffin oils, ester oils, higher alcohols capable of flowing at room temperature and/or ethers thereof or homologs thereof melting at moderately elevated temperatures. One embodiment of the invention is characterized by the use of combinations of desensitizing agents with disintegrating agents and/or cold-soluble auxiliaries.

The auxiliaries described in connection with desensitization of the nonionic surfactants may even be applied as an outer shell to the portioned pressings which inter alia increases there resistance to atmospheric moisture. This can be important in special cases where, in view of the basic composition selected, the pressings still show unwanted sensitivity to atmospheric moisture, particularly in the event of prolonged storage.

Another embodiment of the invention is based on detergents which are present in the form of the described portioned pressings and which contain typical ingredients of detergents, for example anionic and nonionic surfactants, builders, inorganic electrolytes, redeposition inhibitors, foam inhibitors, bleaches and bleach activators, optical brighteners, enzymes, fabric softeners and dyes and fragrances.

Suitable anionic surfactants are, for example, soaps of natural or synthetic, preferably saturated, fatty acids. Soap mixtures derived from natural fatty acids, for example coconut oil, palm kernel oil or tallow fatty acids, are particularly suitable. Mixtures of which 50 to 100% consist of saturated $C_{12-18}$ fatty acid soaps and 0 to 50% of oleic acid soap are preferred.

Other suitable synthetic anionic surfactants are those of the sulfonate and sulfate type.

Suitable surfactants of the sulfonate type are alkyl benzenesulfonates, more particularly $C_{9-13}$ alkyl benzenesulfonates, olefin sulfonates, i.e. mixtures of alkene and hydroxyalkane sulfonates and also disulfonates of the type obtained, for example, from $C_{12-18}$ monoolefins with a terminal or internal double bond by sulfonation with gaseous sulfur trioxide and subsequent alkaline or acidic hydrolysis of the sulfonation products. Other suitable surfactants of the sulfonate type are dialkanesulfonates obtainable from $C_{12-18}$ alkanes by sulfochlorination or sulfoxidation and subsequent hydrolysis or neutralization or by addition of bisulfites onto olefins and, more particularly, the esters of $\alpha$-sulfofatty acids (ester sulfonates), for example the $\alpha$-sulfonated methyl esters of hydrogenated coconut oil, palm kernel oil or tallow fatty acids.

Suitable surfactants of the sulfate type are the sulfuric acid monoesters of primary alcohols of natural and synthetic origin, i.e. of fatty alcohols, for example coconut oil fatty alcohols, tallow fatty alcohols, oleyl alcohol, lauryl, myristyl, palmityl or stearyl alcohol, or the $C_{10-20}$ oxoalcohols and those of secondary alcohols of the same chain length. Sulfuric acid monoesters of the alcohols ethoxylated with 1 to 6 mol ethylene oxide, such as 2-methyl-branched $C_{9-11}$ alcohols containing on average 3.5 mol ethylene oxide, are also suitable, as are sulfated fatty acid monoglycerides.

The anionic surfactants may be present in the form of their sodium, potassium and ammonium salts and in the form of soluble salts of organic bases, such as mono-, di- or triethanolamine. The content of anionic surfactants or anionic surfactant mixtures in the detergents according to the invention is preferably between 5 and 40% by weight and, more particularly, between 8 and 30% by weight.

Suitable nonionic surfactants are adducts of 1 to 40 mol and preferably 2 to 20 mol ethylene oxide with 1 mol of an aliphatic compound essentially containing 10 to 20 carbon atoms from the group consisting of alcohols, carboxylic acids, fatty amines, carboxylic acid amides or alkane sulfonamides. Adducts of 8 to 20 mol ethylene oxide with primary alcohols, for example with coconut oil or tallow fatty alcohols, with oleyl alcohol, with oxo alcohols or with secondary alcohols containing 8 to 18 and preferably 12 to 18 carbon atoms are particularly important.

In addition to the water-soluble nonionics, however, water insoluble or substantially water-insoluble polyglycol ethers containing 2 to 7 ethylene glycol ether units in the molecule are of interest, particularly when they are used together with water-soluble nonionic or anionic surfactants.

Other suitable nonionic surfactants are alkyl glycosides corresponding to the general formula $R—O—(G)_x$, in which R is a primary, linear or 2-methyl-branched aliphatic radical containing 8 to 22 and preferably 12 to 18 carbon atoms, G is a symbol which stands for a glycose unit containing 5 or 6 carbon atoms and the degree of oligomerization x is between 1 and 10.

Suitable organic and inorganic builders are soluble and/or insoluble components which show a mildly acidic, neutral or alkaline reaction and which are capable of precipitating or complexing calcium ions. Suitable and, in particular, ecologically safe builders are, for example, finely crystalline, synthetic water-containing zeolites of the NaA type in detergent quality. Their particle size is normally in the range from 1 to 10 μm. Their content is generally from 0 to 40% by weight, preferably from 10 to 35% by weight and, more preferably, from 15 to 32% by weight, based on anhydrous substance. Other builders which may be used in particular together with the zeolites include (co)polymeric polycarboxylates, such as polyacrylates, polymethacrylates and, in particular, copolymers of acrylic acid with maleic acid, preferably those of 50% to 10% maleic acid. The relative molecular weight of the homopolymers is generally in the range from 1000 to 100,000 while the relative molecular weight of the copolymers is in the range from 2000 to 200,000 and preferably in the range from 5000 to 120,000, based on free acid. A particularly preferred acrylic acid/maleic acid copolymer has a relative molecular weight in the range from 50,000 to 100,000. Suitable, but less preferred compounds of this class are copolymers of acrylic acid or methacrylic acid with vinyl ethers, such as vinyl methyl ether, in which the acid makes up at least 50%.

Other organic builders are, for example, polycarboxylic acids preferably used in the form of their sodium salts, such as citric acid and nitrilotriacetate (NTA), providing their use does not involve any ecological risks.

Suitable inorganic non-complexing electrolyte salts are the bicarbonates, carbonates, borates or silicates of the alkali metals also known as "washing alkalis". Of the alkali metal silicates, sodium silicates with a ratio of $Na_2O$ to $SiO_2$ of 1:1 to 1:3.5 are particularly suitable.

Redeposition inhibitors are used to keep the soil separated from the fibers suspended in the wash liquor and, hence, to prevent its redeposition. Suitable redeposition inhibitors are water-soluble, generally organic colloids such as, for example, the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and starch products other than those mentioned above, for example degraded starch, aldehyde starches, etc., may also be used. Polyvinyl pyrrolidone is also suitable. Carboxymethyl cellulose (Na salt), methyl cellulose, methyl hydroxyethyl cellulose and mixtures thereof are also preferably used.

The foaming power of the surfactants may be increased or reduced by combinations of suitable types of surfactant. A reduction can also be obtained by additions of non-surface-active organic substances. Reduced foaming power, which is desirable for washing machines, is often achieved by combining various types of surfactants, for example sulfates and/or sulfonates with nonionics and/or with soaps. In the case of soaps, the foam-inhibiting effect increases with the degree of saturation and the C chain length of the fatty acid component. Accordingly, suitable foam-inhibiting soaps are natural and synthetic soaps which have a high percentage content of $C_{18-24}$ fatty acids. Suitable non-surface-active foam inhibitors are, for example, organopolysiloxanes and mixtures thereof with silanized silica, paraffins, waxes, microcrystalline waxes and mixtures thereof with silanized silica.

Among the compounds yielding $H_2O_2$ in water which serve as bleaches, sodium perborate tetrahydrate ($NaBO_2.H_2O_2.3\ H_2O$) and sodium perborate monohydrate ($NaBO_2.H_2O_2$) are particularly important. Other useful bleaches are, for example, peroxycarbonate ($Na_2CO_3.1.5\ H_2O_2$), peroxypyrophosphates, citrate perhydrates and $H_2O2$-yielding peracidic salts or peracids, such as perbenzoates, peroxophthalates, diperazelaic acid or diperdodecanedioic acid.

In order to obtain an improved bleaching effect where washing is carried out at temperatures of 60° C. or lower, bleach activators may be incorporated in the preparations. Examples of bleach activators are N-acyl and O-acyl compounds which form organic peracids with $H_2O_2$, preferably N,N'-tetraacylated diamines, such as N,N,N,N'-tetraacetyl ethylenediamine; carboxylic anhydrides and esters of polyols, such as glucose pentaacetate.

The detergents may contain derivatives of diaminostilbene disulfonic acid or alkali metal salts thereof as optical brighteners. Suitable optical brighteners are, for example, salts of 4,4'-bis-(2-anilino-4-morpholino-1,3,5-trazin-6-ylamino)-stilbene-2,2,-disulfonic acid or compounds of similar structure which, instead of the morpholino group, contain a diethanolamino group, a methylamino group, an anilino group or a 2-methoxyethylamino group. Brighteners of the substituted 4,4'-distyryl diphenyl type, for example the compound 4,4'-bis- (4-chloro-3-sulfostyryl)-diphenyl, may also be present. Mixtures of the brighteners mentioned above may also be used. Suitable enzymes are enzymes from the class of proteases, lipases and amylases and mixtures thereof. Enzymes obtained from bacterial strains or fungi, such as *Bacillus subtilis, Bacillus licheniformis* and *Streptomyces griseus*, are particularly suitable. The enzymes may be adsorbed to supports and/or may be encapsulated in shell-forming substances to protect them against premature decomposition.

Suitable stabilizers, particularly for per compounds and enzymes, are the salts of polyphosphonic acids, such as 1-hydroxyethane-1,1-diphosphonic acid (HEDP) or diethylenetriamine pentamethylenephosphonic acid (DTPMP or DETPMP).

The portioned pressings may be directly added to the washing during loading of the washing machine and do not have to be flushed in from a separate compartment. Accordingly, there is also no longer any need for the dispensers widely used at present which are intended to accommodate powder-form detergent and which are directly introduced into the machine together with the washing.

EXAMPLES

Examples 1 to 3

To produce the pressings portioned in tablet form according to Examples 1 to 3 below, highly compacted and dried granules having the following composition were first produced under the conditions according to the invention for the granulation stage:

| | |
|---|---|
| Zeolite NaA (anhydrous) | 37% by weight |
| Sodium dodecyl benzenesulfonate (ABS) | 15% by weight |
| Sodium soap based on tallow fatty acid | 2% by weight |
| Soda, anhydrous | 14% by weight |
| Waterglass ($Na_2O:SiO_2$ = 1:3.3) | 4% by weight |
| Sodium salt of an acrylic acid/maleic acid copolymer (Sokalan CP5 ®) | 6% by weight |
| $C_{12-18}$ fatty alcohol + 5 EO | 6% by weight |
| Tallow fatty alcohol + 5 EO | 2% by weight |
| Water and a small amount of other ingredients, such as optical brighteners, phosphonate and inorganic salts | 14% by weight |

To produce these highly compacted granules, a substantially nonionic-free tower powder of 20.5% by weight zeolite NaA, 10.6% by weight ABS, 2% by weight soap, 14% by weight soda, 4% by weight waterglass, 4.5% by weight Sokalan CP5 ®, 1% by weight tallow alcohol containing 5 ethyleneoxide groups (EO) and 6.6% by weight water and other constituents (percentages by weight based on the formulation as a whole) and a nonionic-containing carrier bead of 16.5% by weight zeolite NaA, 6% by weight $C_{12-18}$ fatty alcohol+5 EO, 1.5% by weight Sokalan CP ® and 4.5% by weight water was mixed as follows with 7.3% by weight of an aqueous 60% by weight ABS paste:

The tower powder and the carrier beads were introduced into a 20 liter batch mixer equipped with a size-reducing unit in the form of a cutter head and were mixed together with the mixer and cutter head both running. The aqueous ABS paste was then pumped in and mixed with the resulting mixture. The premix thus obtained was free-flowing and was delivered to a pellet press of which the cavity block was provided with bores 1.5 mm in diameter. The strands issuing from the cavity block were cut to a length of approx. 1.5 mm. The highly compacted granules accumulating were freed from the water introduced by the ABS paste in a discontinuous fluidized-bed dryer at an inflowing air temperature of approx. 75° to 80° C.

Other laundry detergent ingredients and, optionally, additional tabletting aids were then added to the dry free-flowing granules thus obtained in accordance with Examples 1 to 3 below. In Example 3, the microcrystalline cellulose was added in a rounding machine (Marumerizer) before subsequent drying in the fluidized bed. The thoroughly mixed paste was then pressed in a hydraulic press (manufacturer: Kürschner, Federal Republic of Germany) under pressures of from about 10 to 100 bar to form portioned tablets. Particulars of Examples 1 to 3 are given in the following.

Example 1

The pellets described above were mixed with the following components in the quantities indicated:

Pellets 74.1% by weight
Perborate monohydrate 16.0% by weight
Tetraacetyl ethylenediamine granules (TAED) 5.8% by weight
Silicone-based foam inhibitor 2.5% by weight
Detergent enzyme (Savinase) 1.6% by weight.

Tablets having the following dimensions and properties were produced:

Tablet weight 52 g
Tablet diameter 38 mm
Tablet height 39.5 mm
Breaking strength 80 to 90N
Tablet density 1.16 g/cm$^3$.

When the detergent tablets were used in a domestic washing machine at 30° C., no tablet residues were found in the washing after a washing time of 30 minutes.

Example 2

The following mixture was tabletted as described above:

Pellets 72.1% by weight
Perborate monohydrate 16.0% by weight
TAED granules 5.8% by weight
Silicone-based foam inhibitor 2.5% by weight
Detergent enzyme (Savinase) 1.6% by weight
Microcrystalline cellulose 2.0% by weight The tablets produced as described had the following properties:

Weight 53 g
Diameter 38 mm
Height 40.3 mm
Breaking strength 100 to 120N
Density 1.16 g/cm$^3$.

When used in a washing machine (30° C.), no tablet residues were found after a washing time of 15 minutes.

Example 3

The following mixture was tabletted:

Pellets 68.9% by weight
Perborate monohydrate 14.9% by weight
TAED granules 5.4% by weight
Foam inhibitor 2.3% by weight
Detergent enzyme 1.5% by weight
Urea 5% by weight
Microcrystalline cellulose (added during rounding) 2% by weight.

Dimensions and properties of the tablets:

Weight 56 g
Diameter 38 mm

Height 41.1 mm
Breaking strength 90 to 100N
Density 1.20 g/cm$^3$.

When used in a washing machine (30° C.), no tablet residues were found after 10 minutes.

Example 4

In a mixer of the type described above, a spray-dried tower powder was directly mixed with the nonionic surfactant, of which 20% by weight consisted of $C_{12-14}$ fatty alcohol+3 EO and 80% by weight of $C_{12-18}$ fatty alcohol+5 EO, and a 40% aqueous ABS paste in the following quantities:

Tower powder 83.7% by weight
Nonionic surfactant 5.3% by weight
40% ABS paste 11% by weight The free-flowing dry mixed product was extruded through an extruder using a perforated die with 1.5 mm diameter bores, a temperature of 40° C. and a pressure of 70 bar. The strand-like extrudate issuing from the extruder was cut into 1.5 mm long granules and treated with microcrystalline cellulose in a rounding machine (Marumerizer). The granules formed were dried with hot air in a fluidized bed dryer in the same way as described in Examples 1 to 3.

The granules thus formed had the following composition:

Zeolite NaA (anhydrous) 29% by weight
ABS 16% by weight
Sodium soap based on tallow fatty acid 1% by weight
Soda (anhydrous) 21% by weight
Waterglass ($Na_2O:SiO_2=1:2.0$) 3% by weight
Sokalan CP5 ® 8% by weight
Nonionic surfactant 6% by weight
Tallow alcohol+5 EO 2% by weight
Water and a small amount of other ingredients, such as optical brighteners, phosphonate and inorganic salts 14% by weight.

The following components were added to the granules for subsequent tabletting:

Extrudate 68.1% by weight
Sodium percarbonate 15% by weight
TAED granules 5.8% by weight
Silicone-based foam inhibitor 2.5% by weight
Detergent enzyme (Savinase) 1.6% by weight
Microcrystalline cellulose (added during rounding) 2.0% by weight
Sodium acetate 5.0% by weight.

The granules were formed in a hydraulic press in the same way as described in Examples 1 to 3. The dimensions and properties of the tablets produced were as follows:

Weight 56 g
Diameter 38 mm
Height 40.5 mm
Breaking strength 60N
Density 1.22 g/cm$^3$.

When these detergent tablets were used in a washing machine at 30° C., no tablet residues were found in the washing after a washing time of 15 minutes.

Example 5 (Comparison)

The mixture described in the following was granulated in a pellet press (cavity block with 2 mm bores, cut length of the pellets 1 to 2 mm) and subsequently dried in a fluidized bed, the product temperature not exceeding 50° C. The mixture was obtained as follows:

36.7% by weight of absorbent spray-dried carrier beads based on 75% by weight zeolite NaA (anhydrous), 4% by weight Sokalan CP5 ®, 3% by weight tallow alcohol+5 EO 3% by weight sodium soap based on tallow fatty acid and bound water and a mixture of 6.7% by weight 60% ABS paste, 1.1% by weight tallow alcohol+5 EO and 4.8% by weight $C_{12-18}$ fatty alcohol+5 EO were mixed with 5.5% by weight 90% ABS powder, 12.3% by weight soda (anhydrous), 2.4% by weight 83% sodium silicate ($Na_2O:SiO_2=1:3.3$) and 9.9% by weight of a 50% Sokalan compound (remainder soda and water). 2.6% by weight of a 30% aqueous 1-hydroxyethane-1,1-diphosphonic acid sodium salt solution were then added. The mixture was intensively mixed. 16% perborate monohydrate were introduced shortly before further processing to pellets.

For tabletting, the granules (pellets) obtained in the described form and dried were mixed with the following components:

Pellets 90.1% by weight
TAED granules 5.8% by weight
Foam inhibitor 2.5% by weight
Detergent enzyme 1.6% by weight.

Tabletting was again carried out in a hydraulic press (Kürschner, Federal Republic of Germany). The tablets obtained had the following properties:

Weight 52 g
Diameter 38 mm
Height 34 mm
Breaking strength 80N
Density 1.35 g/cm$^3$.

When these detergent tablets were used in a washing machine at 30° C., tablet residues (12 g) were found in the washing after a washing time of 40 minutes.

Example 6

Before processing to form the free-flowing premix, the carrier beads produced in accordance with Example 5 were charged with the nonionic surfactant ($C_{12-18}$ fatty alcohol+5 EO). The carrier beads thus charged were then mixed with the other constituents as described in Example 5 using the 60% aqueous ABS paste as lubricant and plasticizer. Further processing was carried out at as described in Example 5. The tablets obtained in this way had the following properties:

Weight 52 g
Diameter 38 mm
Height 35.5 mm
Breaking strength 60 to 80N
Density 1.29 g/cm$^3$.

When these detergent tablets were used in a domestic washing machine at 30° C., no tablet residues were found after a washing time of 20 to 25 minutes.

We claim:

1. The process of producing a detergent in the form of portioned pressings, comprising extruding a homogenous premix containing a plasticizer or lubricant into strands through a perforated die under a pressure of from about 25 to about 200 bar, forming compacted granules thereof, and pressing said compacted granules under a pressure of from about 1 to about 300 bar to form said portioned pressings.

2. A process as in claim 1 wherein said portioned pressings have a density greater than about 1 g/cm$^3$.

3. A process as in claim 1 wherein after said step of forming said compacted granules, adding a dissolving or disintegrating aid to said compacted granules, in a quantity of up to about 15% by weight, based on the weight of said portioned pressings.

4. A process as in claim 1 wherein prior to said pressing step, adding to said compacted granules a liquid desensitizing agent selected from the group consisting of a paraffin oil, ester oil, higher alcohol and an ether.

5. A process as in claim 1 wherein said portioned pressings are produced in the form of cylindrical or square tablets having a diameter to length ratio of from about 0.5:2 to about 2:0.5.

6. A process as in claim 1 wherein said strands are cut into granules having a predetermined size by means of a cutting unit.

7. A process as in claim 1 wherein said compacted granules comprise a mixture of:

a) compacted granules containing a nonionic surfactant; and b) compacted granules substantially free of a nonionic surfactant.

* * * * *